US006189774B1

(12) United States Patent
Pearson

(10) Patent No.: US 6,189,774 B1
(45) Date of Patent: Feb. 20, 2001

(54) POSTCARD FOR MAILING AND DISPLAYING A PHOTOGRAPH

(76) Inventor: C. Steven Pearson, 6123 Premiere Ave., Lakewood, CA (US) 90712

( * ) Notice: Under 35 U.S.C. 154(b), the term of this patent shall be extended for 0 days.

(21) Appl. No.: 09/491,689

(22) Filed: Jan. 26, 2000

(51) Int. Cl.[7] ..... B65D 27/00
(52) U.S. Cl. ..... 229/92.8; 229/71; 229/72
(58) Field of Search ..... 229/92.8, 72, 71

(56) References Cited

U.S. PATENT DOCUMENTS

| | | | | |
|---|---|---|---|---|
| 944,385 | * | 12/1909 | Spiegel | 229/71 X |
| 1,265,159 | * | 5/1918 | Alexander | 229/71 X |
| 1,858,277 | * | 5/1932 | Overly | 229/71 |
| 1,964,595 | * | 6/1934 | Overly | 229/71 |
| 3,762,630 | * | 10/1973 | Braznell | 229/92.8 |
| 4,079,881 | | 3/1978 | Sabb . | |
| 4,237,633 | | 12/1980 | Murrell . | |
| 4,366,636 | * | 1/1983 | Hearsh | 229/71 X |
| 4,662,093 | | 5/1987 | Suttles et al. . | |
| 4,807,807 | | 2/1989 | Glick . | |
| 4,825,574 | * | 5/1989 | George | 229/92.8 X |
| 4,953,780 | | 9/1990 | Ross . | |
| 5,647,938 | | 7/1997 | Levine . | |
| 5,788,144 | * | 8/1998 | Sorge et al. | 229/71 X |

FOREIGN PATENT DOCUMENTS

| | | | | |
|---|---|---|---|---|
| 698438 | * | 1/1931 | (FR) | 229/72 |
| 13475 | * | of 1906 | (GB) | 229/71 |

* cited by examiner

*Primary Examiner*—Jes F. Pascua
(74) *Attorney, Agent, or Firm*—James G. O'Neill

(57) ABSTRACT

An improved postcard for mailing and displaying a photograph and a blank for and method of making the same is disclosed herein. The postcard is made from the blank, which is folded and then secured together along outer edges thereof, by flaps formed in the blank. One of the flaps is left open so that a photograph may be inserted into a pocket formed in the postcard, so as to be seen through a transparent window secured to one side of a front portion of the formed postcard. After insertion of the photograph, the open side of the pocket is permanently sealed by the open flap, and the postcard may be sent through the mail. The postcard includes a triangular element held on a rear surface thereof, which triangular element is rotatable to an open position to support the postcard in an elevated or standing position, whereby the photograph may be easily viewed through the transparent window.

8 Claims, 3 Drawing Sheets

POSTCARD FOR MAILING AND DISPLAYING A PHOTOGRAPH

BACKGROUND OF THE INVENTION

1. Field of the Invention

This invention relates generally to postcards, and, more particularly, to an improved postcard in which a photograph taken by a user may be inserted and mailed in a protective envelope, and which envelope may be used to display the photograph.

2. Description of Related Art

A number of photograph mailing postcards and apparatus for making the same are known, examples of such prior art postcards and apparatus are disclosed in U.S. Pat. No. 4,079,881 to Sabb, U.S. Pat. No. 4,237,633 to Murrell, U.S. Pat. No. 4,662,093 to Suttles et al., U.S. Pat. No. 4,807,807 to Glick, U.S. Pat. No. 4,953,780 to Ross, and U.S. Pat. No. 5,647,938 to Levine. Although these prior art postcards and apparatus for making the same have solved numerous problems, and allowed some persons to make photo postcards, or mail photographs in postcards, they are not applicable or useful in all situations. Nor, have the prior art postcards for sending photographs been readily available, or easy to manipulate.

Therefore, there exists the need in the art for an easy to use and manufacture postcard for holding and mailing photographs.

SUMMARY OF THE INVENTION

It is, therefore, a general object of the present invention to provide an improved and simplified postcard. It is a particular object of the present invention to provide an improved postcard having an opening therein for insertion and mailing of a photograph. It is another particular object of the present invention to provide an improved postcard having an easily sealable open edge. It is a further particular object of the present invention to provide an improved postcard into which a photograph may be easily inserted and sealed for mailing. And, it is yet another particular object of the present invention to provide a postcard for securely holding and mailing a photograph, and which includes a fold-out element for supporting the postcard and photograph in a standing position.

These and other objects and advantages of the present invention are achieved by providing a postcard, which is made from a cut-out blank, folded and sealed, so as to form a pocket having an opening at one end thereof, whereby a photograph may be inserted and securely sealed in the pocket, and which further includes a perforated element at the rear thereof, which may be withdrawn and moved into position to support and display the photograph after receipt by a party.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified postcard for mailing and displaying a photograph, generally indicated at 10, throughout the several views.

Figure 1:
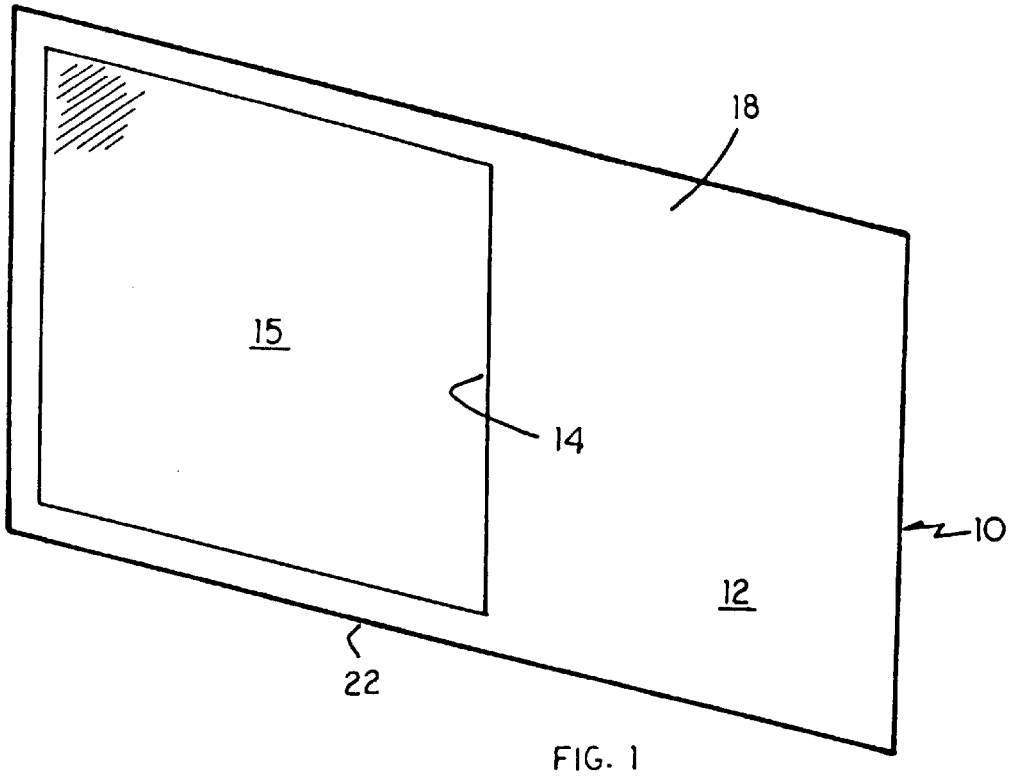
FIG. 1 is a front perspective view of an improved postcard for mailing and displaying a photograph of the present invention.

Turning now to the drawings, FIG. 1 show a preferred embodiment of the postcard 10 having a first or upper portion with a first, front or outside surface 12 having a rectangular window 14, of any desired size, formed between the front surface and a rear surface 16 so as to show a photograph through the window 14. A transparent material 15 is secured to the rear surface 16 of the first or upper portion 18 (see FIG. 5) to enable the photograph held within the postcard to be protected while being held in a pocket behind the rectangular opening 14. The front surface 12 and the rear surface 16 are formed on the upper portion 18 of a blank 24, and connected to a lower or second portion 20 by a fold line 22. The blank 24 is die-cut or otherwise formed to have the specific shape shown in FIG.5, and the transparent layer 15 is secured to the rear surface 16 of the formed element 24 in a known manner. The lower portion 20 of the blank 24 includes a front or inner face 26 and a rear or outside face 28. Additionally, the upper portion 18 of the blank 24 includes three trapezoidal-shaped flap portions 30, 32, 34, having angular cut off end portions secured thereto, as shown in FIGS. 2–8.

Figure 2:
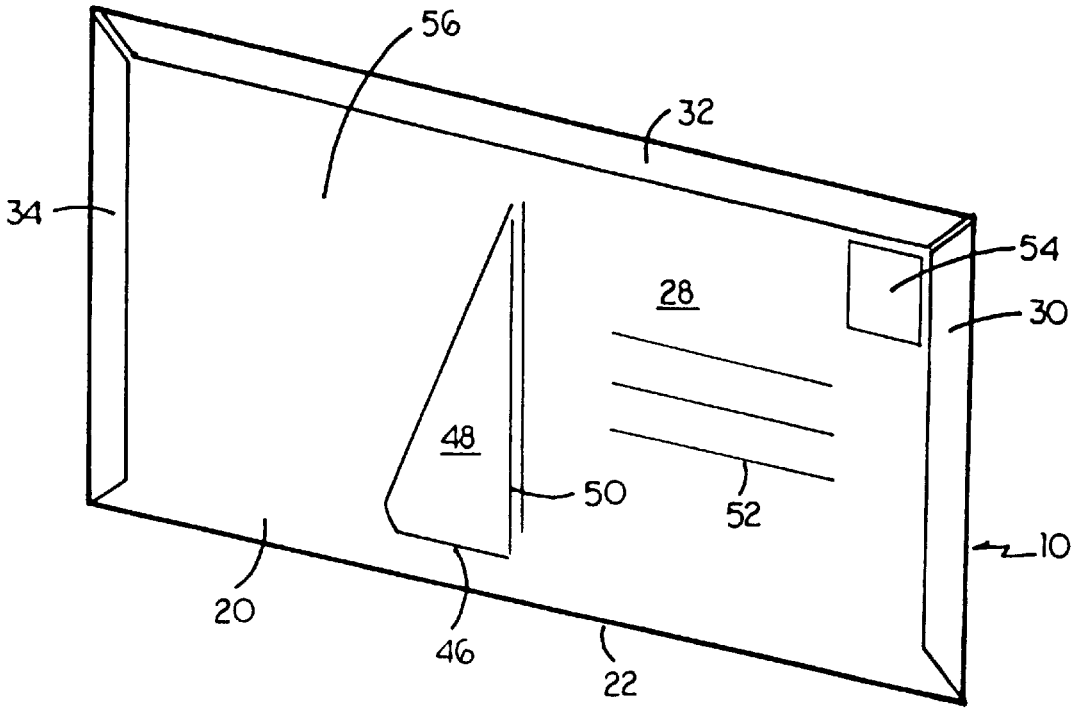
FIG. 2 is a rear perspective view of the postcard of FIG. 1.
Figure 3:
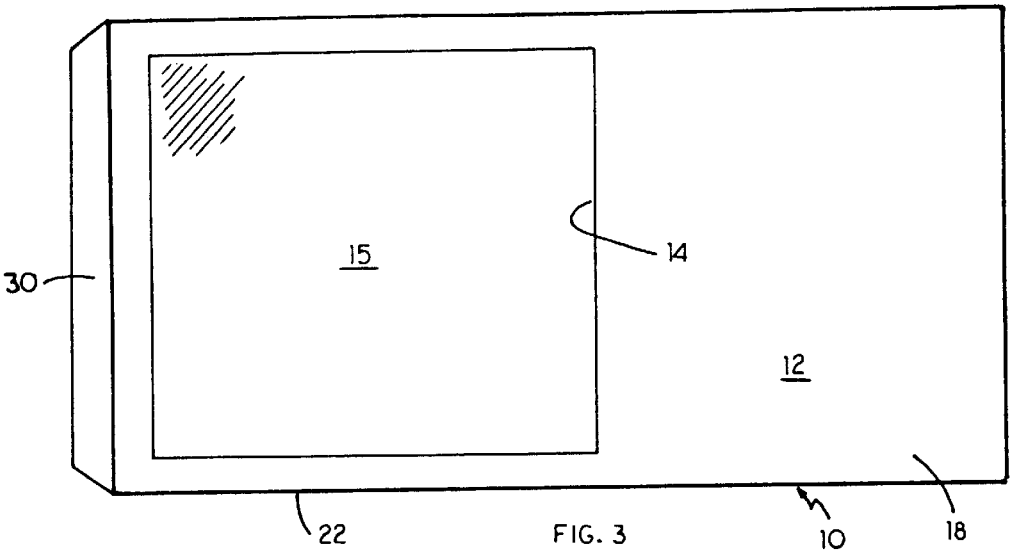
FIG. 3 is a front elevational view of the improved postcard for mailing and displaying a photograph of the present invention.

As best shown in FIGS. 5–8, the improved postcard of the present invention is formed from the blank 24 by folding the lower portion 20 and upper portion 18 together, along fold line 22, in the direction of arrows 36, 38, until rear surface 16 and inner face 26 are brought together, so that adhesive strip 40 on the rear surface 16 contacts inner face 26 between the fold line 22 and the outer edge. When brought together, the adhesive strip 40 permanently seals the rear surface 16 and inner face 26 together to form an interior pocket between the adhesive strip and the left outer edge, having a flap 30 thereon. Each of the flaps 32 and 34 include an adhesive thereon, such as a pressure sensitive adhesive, and may include a release liner, or the like, secured thereto. The release liner, if used, is removed from flaps 32 and 34, and these flaps folded over to contact and be permanently secured over the edges and against outside face 28 of lower portion 20, as more clearly shown in FIGS. 2 and 4. Flap 30 is left open and unsecured, so that a photograph may be inserted in the direction of an arrow 44, over flap 30, into the pocket formed between flap 30 and the secured portion to defined by adhesive strip 40. When properly inserted in the pocket, the photograph will show through the transparent window 15 and rectangular opening 14. After the photograph is inserted in the desired manner within the pocket formed behind the transparent window 15, a release liner, if used, is removed from a further adhesive strip 42 and the flap 30 is folded over to permanently cover the left edge and to adhere to the outside face 28 of lower portion 20. This permanently secures the photograph within the pocket in the postcard, as shown in FIG. 2. The folded over flaps 30, 32 and 34 together with the lower edge formed along fold line 22 ensure that the postcard has sealed and covered outer edges, which securely hold the photograph in the pocket.

Figure 4:
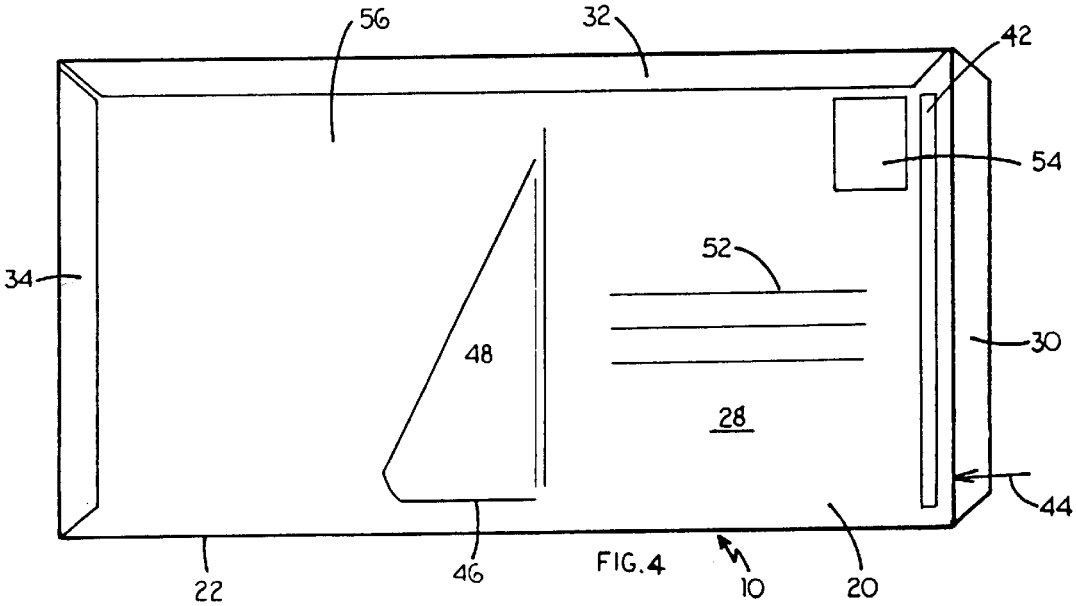
FIG. 4 is a rear elevational view of FIG. 3.
Figure 5:
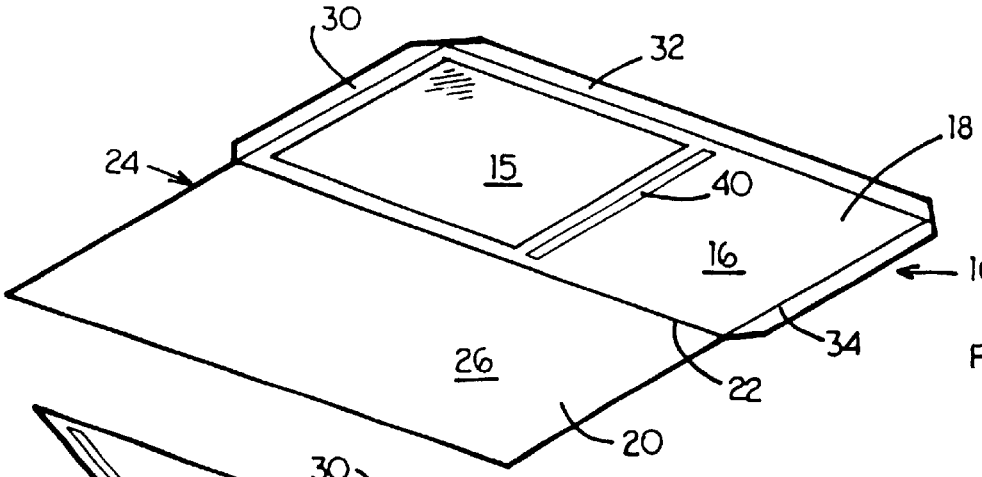
FIG. 5 is a top perspective view of a blank or form, which is cut out or formed, and then folded and sealed in position to form the improved postcard of the present invention.
Figure 6:
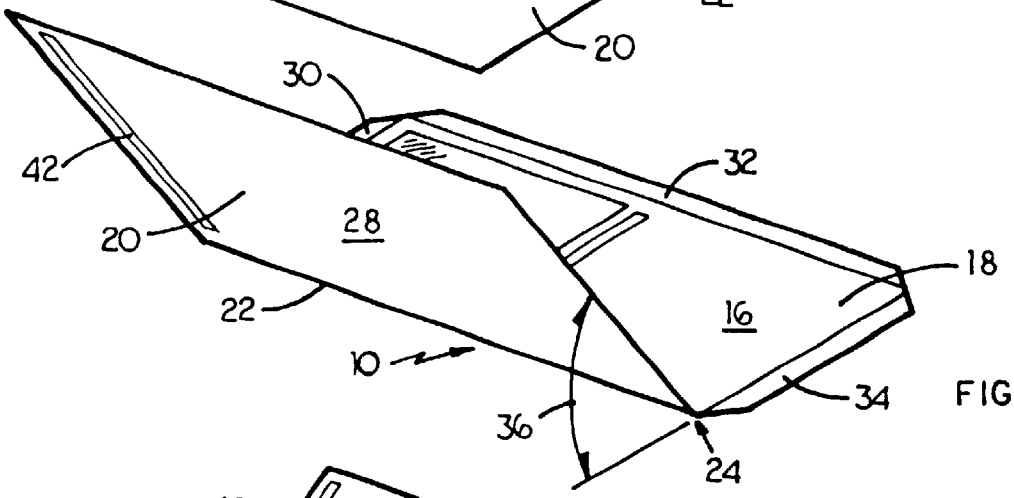
FIG. 6 is a further perspective view of the blank or form showing upper and lower portions thereof, being bent into position to be sealed together.
Figure 7:
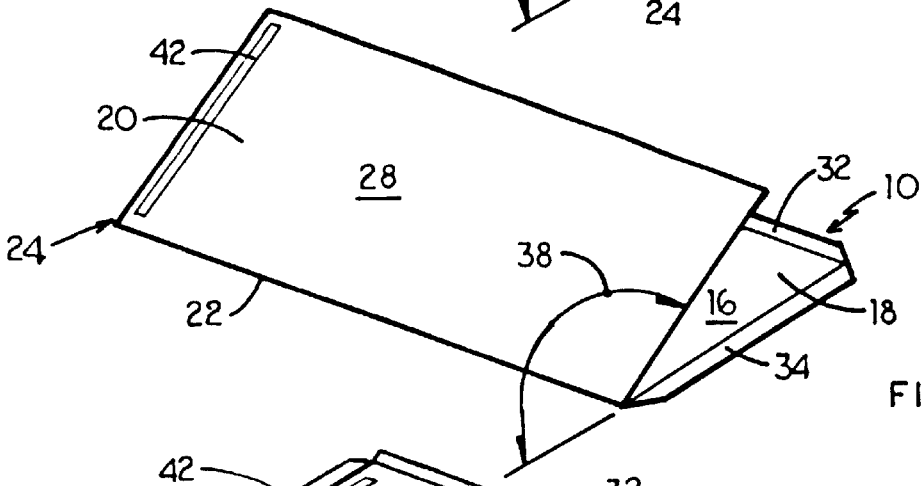
FIG. 7 is a further perspective view showing the upper and lower portions folded to a point to just before they meet to form the postcard of the present invention.
Figure 8:
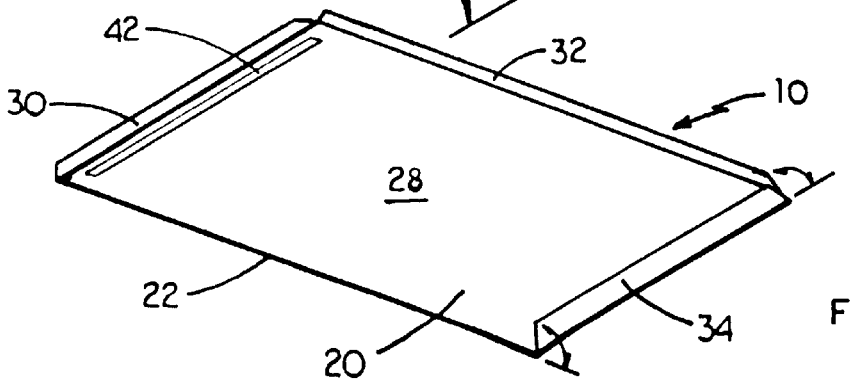
FIG. 8 is a further perspective view showing the postcard with the inner surfaces of the upper and lower portions secured together with a right side flap and a top edge flap moved into position to seal the postcard and form a pocket with a left side edge open, so that a photograph may be inserted into the pocket, a release liner removed and the left edge flap sealed in position to show the photograph through an open window, so as to be viewed from the front of the postcard.

As best shown in FIGS. 2 and 4, the front or outside face 28 of the lower portion 20 includes a triangular-shaped opening 46 having a triangular-shaped element 48 held therein. The triangular-shaped element 48 is releasably secured within the opening 46, as by means of perforated holding means along two sides, which are formed when the blank 24 is die-cut. The triangular-shaped element 48 is easily removable so that it may be rotated outwardly around a fold line 50 to form a support to allow the postcard 10 to be displayed on a flat surface, in an upright manner, whereby the photograph appearing the transparent window may be easily seen.

As in any known postcard, the rear face 28 includes an address area 52, a stamp affixing area 54 and a blank portion 56 where a greeting or message may be written.

It, therefore, can be seen that the improved postcard of the present invention is easily formed from a die-cut or stamped-out blank of material, having a transparent material secured over a rectangular opening on a first portion thereof. The postcard is formed by bending portions of the blank around a fold line, so as to secure together interior surfaces or faces of upper and lower portions to form an internal pocket for a photograph, and then permanently securing together and covering the outer edges of the held together upper and lower portions, by overlapping flap elements formed on the blank. One of the outer flaps, preferably the left edge flap, is left open so a photograph may be to inserted in the pocket formed behind the transparent window material, so that the photograph may be viewed through a rectangular opening and then sealed in place by securing the open flap.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A postcard mailing and displaying a photograph, comprising:

a rectangular body having a covered and sealed upper edge, a covered and sealed lower edge, an open left end and a covered and sealed right end;

the rectangular body being formed from two portions, which are folded along a fold line and sealed together;

a pocket formed in the rectangular body between an inner secured together area and the open left end;

a flap is held on the open left end to be folded so as to cover and be sealed by an adhesive strip adjacent the open left end, after insertion of photograph through the open left end into the pocket;

one of the two portions includes a rectangular opening on one side, which rectangular opening allows the photograph in the pocket to be viewed; and a transparent material secured over the rectangular opening, to protect the photograph held in the pocket after sealing the left end, during mailing.

2. The postcard of claim 1 wherein the postcard includes a front surface and a rear face, with the rectangular opening formed on the front surface.

3. The postcard of claim 2, further including a triangular-shaped element formed in the rear face, which triangular-shaped element is adapted to be rotated outwardly from the rear face to support the postcard in a raised position, whereby the photograph showing through the rectangular opening may be displayed.

4. The postcard of claim 1 wherein the two secured together portions are comprised of a first portion having a front surface and a rear surface and a second portion having a front face and a rear face, and wherein at least the rear surface includes a strip of adhesive thereon, which strip of adhesive is brought together with the frost face to secure the rear surface to the front face.

5. The postcard of claim 4, further including a rectangular opening formed in the first portion extending through the first portion from the front surface to the rear surface into the pocket; a transparent window material secured to the rear surface and covering the rectangular opening; and a triangular-shaped element formed in the rear face, which triangular-shaped element may be rotated outwardly to support the postcard in a raised position to display the photograph through the transparent window material and the rectangular opening.

6. A method of forming a postcard for mailing a photograph, comprising the steps of:

forming a blank having an upper portion and a lower portion divided by a fold line;

forming the upper portion with three outer trapezoidal-shaped flaps having adhesive thereon;

forming a rectangular opening in the upper portion;

covering the rectangular opening with a transparent window material;

applying a strip of adhesive to an inner surface of the upper portion;

folding the lower portion and the upper portion toward each other along the fold line until the strip of adhesive meets an inner surface of the lower portion to secure the lower portion and the upper portion together with a pocket formed therebetween;

folding two of the three flaps over until they contact an outer face of the lower portion and are secured thereto by the adhesive on the two of the three flaps; and inserting a photograph into the pocket via an opening formed adjacent a third of the three flaps, and folding the third of the three flaps over until it contacts an adhesive strip on the outer face of the lower portion so as to be secured thereto by the adhesive strip.

7. The method of forming a postcard for mailing a photograph of claim 6, comprising the further step of forming a triangular-shaped element in the outer face of the lower portion.

8. A blank for forming a postcard for mailing a photograph, comprising:

an upper portion connected to a lower portion along a fold line;

the upper portion having a front surface, a rear surface, a top edge and two ends with the fold line forming a lower edge;

the top edge and two ends having trapezoidal-shaped flaps formed thereon; and adhesive applied to some of the trapezoidal-shaped flaps;

a rectangular opening formed in the upper portion;

a transparent material secured to the rear surface and covering the rectangular opening;

a first adhesive strip secured to the rear surface, adjacent to an edge of the rectangular opening, spaced from the transparent material and extending between the top edge and the lower edge;

the lower portion including a front face, a rear face, two outer ends, a first outer end and a second inner end formed by the fold line; and a triangular-shaped element formed in the front face.

* * * * *